US009950772B2

(12) United States Patent
Hodapp

(10) Patent No.: US 9,950,772 B2
(45) Date of Patent: Apr. 24, 2018

(54) ONBOARD BOAT LIFT STRUCTURE AND METHOD

(71) Applicant: Hewitt Machine & MFG, Inc., Nicollet, MN (US)

(72) Inventor: Gary D. Hodapp, Madison Lake, MN (US)

(73) Assignee: Hewitt Machine & MFG, Inc., Nicollet, MN (US)

( * ) Notice: Subject to any disclaimer, the term of this patent is extended or adjusted under 35 U.S.C. 154(b) by 0 days.

(21) Appl. No.: 14/869,315

(22) Filed: Sep. 29, 2015

(65) Prior Publication Data

US 2016/0016641 A1 Jan. 21, 2016

Related U.S. Application Data

(63) Continuation of application No. 12/407,096, filed on Mar. 19, 2009, now abandoned.

(60) Provisional application No. 61/037,711, filed on Mar. 19, 2008, provisional application No. 61/037,712, filed on Mar. 19, 2008.

(51) Int. Cl.

| | |
|---|---|
| ***B63C 7/00*** | (2006.01) |
| ***B63B 21/00*** | (2006.01) |
| ***B63B 17/00*** | (2006.01) |
| ***B63B 21/26*** | (2006.01) |
| ***E02B 17/08*** | (2006.01) |
| ***B63C 3/06*** | (2006.01) |

(52) U.S. Cl.

CPC ..... *B63B 21/00* (2013.01); *B63B 17/00* (2013.01); *B63B 21/26* (2013.01); *B63C 3/06* (2013.01); *E02B 17/0809* (2013.01)

(58) Field of Classification Search

CPC ..... B63B 17/00; B63B 21/00; B63C 3/06
USPC ..... 114/1.1, 61.1, 3, 4, 5, 6, 8, 343, 354, 114/360, 44, 284; 384/276, 295, 296, 384/439; 403/119, 161; 405/3, 203
See application file for complete search history.

(56) References Cited

U.S. PATENT DOCUMENTS

| | | | |
|---|---|---|---|
| 2,659,555 | A | 11/1953 | Schiender |
| 2,664,577 | A | 1/1954 | Sanborn |
| 3,021,965 | A | 11/1962 | Harvey |
| 3,177,668 | A | 4/1965 | Schneider et al. |
| 3,260,377 | A | 7/1966 | Vilter |
| 3,300,796 | A | 1/1967 | Powers |
| 3,479,828 | A | 11/1969 | Luque |
| 3,753,355 | A | 8/1973 | Knoch |
| 3,800,727 | A | 4/1974 | Hirsch et al. |

(Continued)

FOREIGN PATENT DOCUMENTS

DE 2345754 A1 3/1975

*Primary Examiner* — Daniel V Venne
(74) *Attorney, Agent, or Firm* — Peter J. Ims; Westman, Champlin & Koehler, P.A.

(57) ABSTRACT

An onboard lift for a pontoon boat has four legs pivotally attached underneath a platform and extending between the outer pontoons. Each leg terminates in a slide foot. The pivot pin for each leg is canted, such as at 13° relative to horizontal. In a stowed position, the legs and slide feet extend forward in the direction of travel and tight to the platform. When used to lift the boat, actuation of the legs pushes the slide feet outward due to the cant of the pivot axis, such that the slide feet are positioned underneath the outer pontoons when the boat is fully raised. The control allows separate powering of the front legs from the rear legs, and further has a display so the user can see the amount of extension of each set of legs.

16 Claims, 5 Drawing Sheets

(56) References Cited

U.S. PATENT DOCUMENTS

| | | | |
|---|---|---|---|
| 3,879,781 | A | 4/1975 | Roschynialski |
| 4,070,987 | A | 1/1978 | Gross et al. |
| 4,254,730 | A | 3/1981 | Crenshaw |
| 4,494,883 | A | 1/1985 | Winter |
| 4,773,346 | A | 9/1988 | Blanding et al. |
| 4,787,327 | A | 11/1988 | Porter |
| 4,850,741 | A | 7/1989 | Timmerman |
| 5,042,417 | A | 8/1991 | Raymond |
| 5,096,159 | A | 3/1992 | Fletcher |
| 5,115,753 | A | 5/1992 | Craddock |
| 5,163,378 | A | 11/1992 | Raymond |
| 5,184,561 | A | 2/1993 | Nickell, Jr. |
| 5,184,914 | A | 2/1993 | Basta |
| 5,199,686 | A | 4/1993 | Fletcher |
| 5,558,034 | A | 9/1996 | Hodapp |
| 5,562,362 | A | 10/1996 | Vezner |
| 5,772,360 | A | 6/1998 | Wood, II |
| 5,888,019 | A | 3/1999 | Quastad |
| 5,908,264 | A | 6/1999 | Hey |
| 6,059,263 | A | 5/2000 | Otema et al. |
| 6,523,491 | B1 | 2/2003 | Moise, II et al. |
| 6,554,533 | B2 | 4/2003 | Godbersen |
| 6,695,336 | B1 | 2/2004 | Grabenstetter |
| 6,823,809 | B2 | 11/2004 | Hey |
| 6,830,002 | B1 | 12/2004 | Walker |
| 6,907,835 | B1 | 6/2005 | Derner et al. |
| 6,976,442 | B2 | 12/2005 | Hey et al. |
| 6,983,707 | B2 | 1/2006 | Derner et al. |
| 7,051,665 | B2 | 5/2006 | Derner et al. |
| 7,156,030 | B2 | 1/2007 | Derner et al. |
| 7,188,580 | B1 | 3/2007 | Borman |
| 7,246,970 | B2 | 7/2007 | Hey |
| 7,267,066 | B2 | 9/2007 | Derner |
| 7,318,385 | B2 | 1/2008 | Darner |

ONBOARD BOAT LIFT STRUCTURE AND METHOD

CROSS-REFERENCE TO RELATED APPLICATION(S)

This application is a Continuation of U.S. application Ser. No. 12/407,096, entitled ONBOARD BOAT LIFT STRUCTURE AND METHOD, now abandoned, which claims priority from Provisional Application No. 61/037,711, filed Mar. 19, 2008, entitled POWER FOR ONBOARD BOAT LIFT, and from Provisional Application No. 61/037,712, filed Mar. 19, 2008, entitled ONBOARD BOAT LIFT STRUCTURE, both incorporated herein by reference.

BACKGROUND OF THE INVENTION

The present invention relates to boat lift structures for raising and supporting boats, and more particularly to boat lift structures which are carried onboard during use of the boat. Examples of such prior art onboard boat lift structures are provided in U.S. Pat. No. 5,042,417 to Raymond, U.S. Pat. No. 5,558,034 to Hodapp, and in a series of patents (U.S. Pat. Nos. 6,907,835, 6,983,707, 7,051,665, 7,156,030, 7,267,066 and 7,318,385) to Derner et al. All these mentioned patents are incorporated by reference.

In general terms, these existing onboard lift structures involve a plurality of legs which are pivotable relative to the boat, from a stowed position wherein the legs are generally parallel to the deck of the boat or horizontal water surface, to a downwardly extended support position wherein the legs are relatively upright, i.e., significantly more upright than in the stowed position. A pad is provided on the free end of the legs which once contacting the ground is intended to provide a stationary foot location. The legs can be independently operable, as disclosed in the Derner et al. patents, or be operable jointly in pairs, as disclosed in the Raymond and Hodapp patents.

While these prior art onboard boat lift structures provide benefits, they also have some shortcomings. With the Raymond structure, the stowed position of the legs and the pads is on the outside of the sides of the boat. This permits easy viewing of the legs and pads during deployment. This location also provides a wide base, with the pads separated by a distance wider than the width of the boat. At the same time, however, the stowed position detracts aesthetically from the appearance of the boat during use, and increases wind resistance during use of the boat. The stowed position of the legs and pads can also interfere with people climbing in and out of the side of the boat.

In contrast to the Raymond structure, the Hodapp and Derner structures are mounted underneath the deck of the boat and interior to the position of pontoons on the bottom of the boat. This location is concealed during the stowed position, does not significantly affect wind resistance during use of the boat, and does not interfere with ingress and egress from the boat. However, the narrow base creates a potentially unstable stand for the pontoon boat when raised, and a stiff wind, particularly if coupled with angled placement or loading of the boat, could create a potentially dangerous or damaging possibility of tipping or flipping the boat off of the narrow base. The legs and pads cannot be viewed during deployment, making deployment more difficult. The drive systems for the legs, and particularly the independent, screw drives of the Derner system, increase the cost of the system. Better structures and methods of lifting boats are needed.

BRIEF SUMMARY OF THE INVENTION

The present invention is an onboard lift for lifting a boat such as a pontoon boat. Right and left legs are moveable between a generally horizontal retracted or stowed position and a relatively upright support position. The legs terminate not in pads of the prior art, but rather in slide feet. The legs pivot about a pivot axis which is canted, and raising of the boat requires the slide feet to slide across the ground surface. With the canted pivot axis of the legs, the slide feet have a wider stance in the support position, including a sufficiently wide stance that the slide feet are located underneath the outer pontoons, even though the mount of the support structure is mounted between the outer pontoons. In another aspect, the onboard lift is operated with a control which provides a display for the front support structures and a separate display for the rear support structures. These displays and buttons on the control enable an operator to easily level the boat when lifted over a sloped grade.

While the above-identified drawing figures set forth one or more preferred embodiments, other embodiments of the present invention are also contemplated, some of which are noted in the discussion. In all cases, this disclosure presents the illustrated embodiments of the present invention by way of representation and not limitation. Numerous other minor modifications and embodiments can be devised by those skilled in the art which fall within the scope and spirit of the principles of this invention.

DETAILED DESCRIPTION

Figure 2:
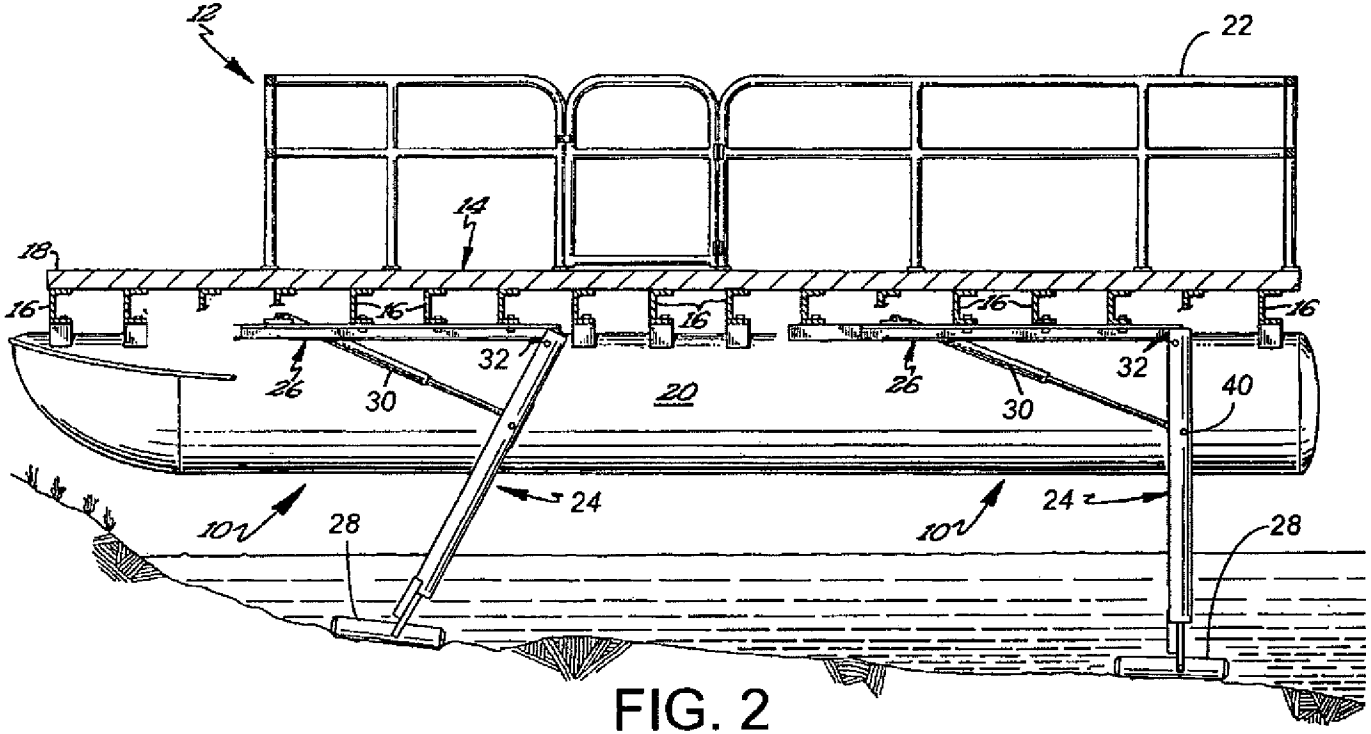
FIG. 2 is a cross-sectional view taken along line 2 of FIG. 1, but shown relative to a typical shoreline.

A lift for watercraft and especially pontoon boats according to the preferred teachings of the present invention is shown in the drawings and generally includes at least two and more preferably four support structures 10. A pontoon boat 12 generally includes a platform 14, which can be formed as shown in FIG. 2 with a plurality of cross members 16 supporting suitable deck material 18. The pontoon boat 12 further generally includes two or more spaced, parallel, flotation units or pontoons 20 positioned underneath the platform 14. A railing 22 normally extends above the platform 14. An outboard motor (not shown) is normally mounted at the rear of platform 14.

In the preferred embodiment, each support structure 10 primarily includes a leg 24 extending from a mounting plate 26 to a slide foot 28, and a power mechanism 30 for operating the support structure 10. Each mounting plate or attachment bracket 26 is suitably secured such as with bolts (not shown) to an attachment surface on the underside of the platform 14, such that each of the support structures 10 is carried onboard the boat 12. When sold as an aftermarket product for attachment to an existing pontoon boat 12, the mounting plates 26 define horizontal for the support structure 10, intended for attachment with the defined horizontal matching the horizontal surface of the water and the horizontal surface of the platform 14. The mounting plates 26 also define the direction of travel of the boat 12, intended to be mounted parallel to the pontoons 20, i.e., to the right or the left of the centerline of the boat 12. The directional terms "right", "left", "front" and "back" as used herein are viewed from the direction of the travel of the boat 12, i.e., "right" means starboard, "left" means port, front means fore and back means aft.

The mount plate 26 supports a pivot pin 32 (best shown in FIG. 3) or similar structure which enables the leg 24 to pivot between an extended support position and a retracted stowed position. From a side view, the movement of the leg 24 between the stowed position and the support position is best shown in FIG. 4.

Figure 3:
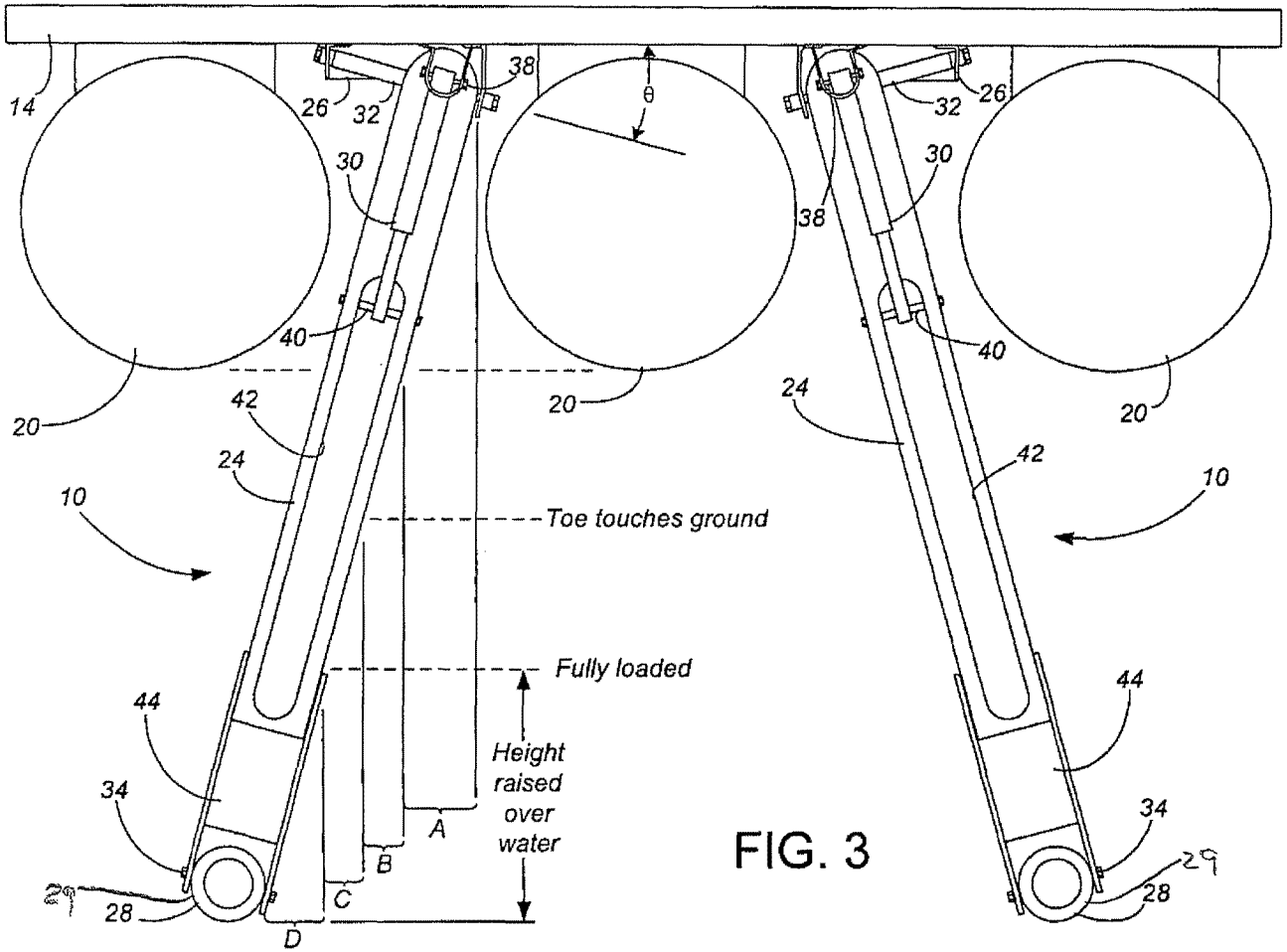
FIG. 3 is a front view of the preferred embodiment of FIG. 1, shown in the extended support position.
Figure 4:
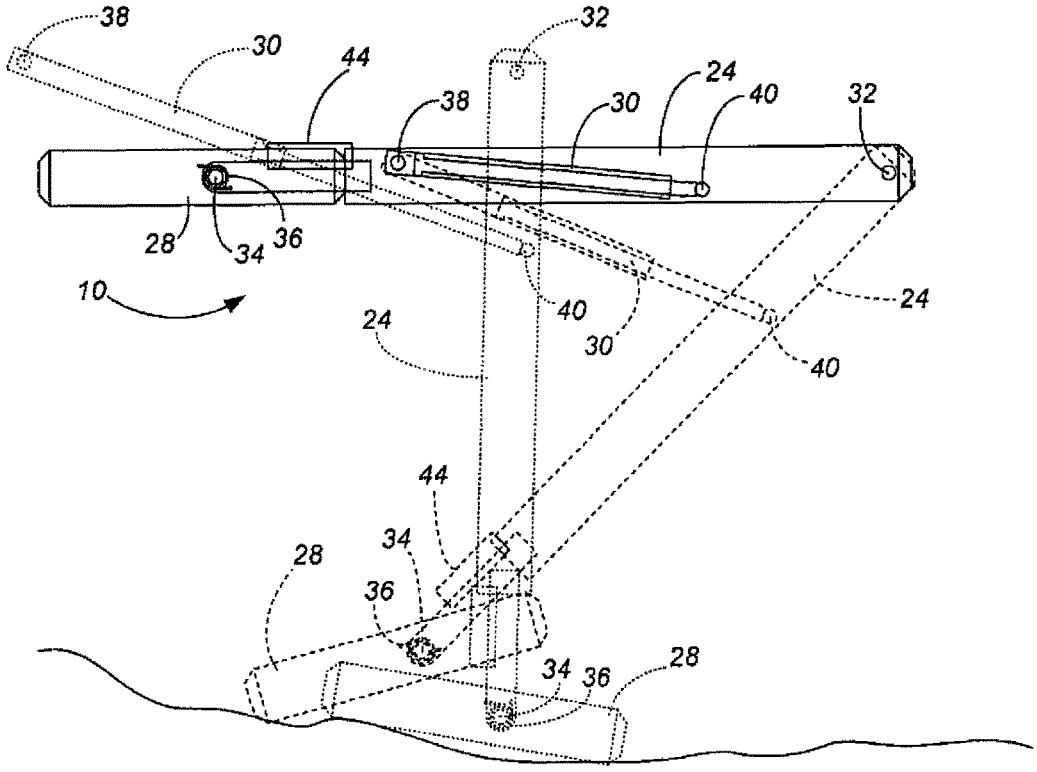
FIG. 4 is a side view of an alternative embodiment of one of the support structures with the hydraulic cylinder beside the leg, and showing the relative positions in the stowed position in solid lines, at contact of the toe to the ground in dashed lines, and in the extended support position in dotted lines.

Each leg 24 terminates in a slide foot 28 which is hinged relative to the leg 24 such as about a slide foot pivot pin 34 (best shown in FIG. 3). The hinge allows the slide foot 28 to extend in line with the leg 24 while in the stowed position. At the same time, the hinge allows the slide foot 28 to contact the ground with the angle of the slide foot 28 matching the angle of the ground.

The length of each leg 24 and the length of each slide foot 28 are selected based upon the anticipated pontoon size and desired lift height. The preferred legs 24 are about 6 feet long from the leg pivot axis to the slide foot pivot axis, and the preferred slide feet 28 extend about 32 inches from toe to heel. The preferred placement of the slide foot hinge is about 60% of the way from the toe to the heel, so the preferred slide foot 28 extends about 20 inches beyond the slide foot pivot axis.

In the stowed position, the legs 24 fit between the outer pontoons 20, that is, are raised to a position fully higher than the bottom of any of the pontoons 20. The preferred stowed position has the legs 24 extending horizontally against the underside of the platform 14 and parallel to the pontoons 20. For most loads, the pontoons 20 elevate the platform 14 six to eighteen inches above the surface of the water, and the stowed position preferably raises the legs 24 close to the undersurface of the platform 14 so the legs 24 in the stowed position are completely out of the water and create no additional drag for the pontoon boat 12. The legs 24 need to be amply strong to support the weight of the pontoon boat 12. In the preferred embodiment, each leg 24 is formed of a cylindrical aluminum tube of six inches in outer diameter and ¼ inch wall thickness.

The legs 24 need to be spaced appropriately to support the weight of the pontoon boat 12. For instance, the preferred embodiment uses four legs 24, a front right leg, a rear right leg, a front left leg and a rear left leg. The positioning of the legs 24 is also preferably such that the support structures 10 are fully underneath (in plan view) and do not extend beyond the platform 14 either in the stowed position or in the support position.

In contrast to prior art structures, the pivot axes of the legs 24 defined by the leg pivot pins 32 are not horizontal and perpendicular to the direction of travel of the pontoon boat 12. Instead, the pivot axis of each leg 24 is canted relative to horizontal and/or direction of travel. The amount of cant θ (shown in FIG. 3) is significant in defining the travel path of the leg 24, such that when the legs 24 are extended, the slide feet 28 are wider than the attachment points of the legs 24 to the deck defined by the mounts 26. The present invention is intended to be useful for both twin tube and triple tube pontoon boats 12, and the amount of cant θ must not be so great as to have the path of travel of the legs 24 interfere or contact any of the pontoons 20. The amount of cant θ is preferably 5 to 30°, and more preferably from 10 to 18° relative to the defined horizontal. The most preferred amount of cant θ is 13° relative to the defined horizontal. The leg 24 then extends perpendicular to its pivot axis.

If desired for the travel path of the leg 24, the pivot axes/leg pivot pins 32 may alternatively or additionally be canted relative to the direction of travel of the boat 12, i.e., not perpendicular to the pontoons 20. The preferred leg travel path is achieved based solely on a vertical cant, with the pivot axis/leg pivot pins 32 being within the plane perpendicular to the direction of travel.

In the preferred embodiment, each leg 24 is lowered or raised by its own power source such as a hydraulic cylinder 30. If desired, each hydraulic cylinder 30 may operate independent of the others, such that each leg 24 is independently moveable relative to the other three legs 24. More preferably, the two front hydraulic cylinders 30 operate in conjunction with each other and the two rear hydraulic cylinders 30 operate in conjunction with each other.

The importance of the canted pivot axis can be readily understood when considering the travel path of the legs 24 and the slide feet 28, detailed particularly with reference to FIGS. 3 and 4. From the stowed position, the hydraulic cylinder 30 moves the leg 24 and its attached slide foot 28 to lower the slide foot 28 relative to horizontal. This movement begins the spread of the slide feet 28. For instance, pontoons 20 are typically about 23 to 25 inches in diameter. With the preferred 13° cant, lowering the slide foot 28 to the bottom of the pontoon 20 moves the slide foot 28 outward an initial widening distance A of more than 5 inches. Accordingly, the mounts 26 must be positioned so the legs 24 in the stowed position are about 5 inches or more inward from the inner side of the outer pontoons 20, to thereby provide clearance for the slide foot 28 as it moves downward and outward. In most pontoon boats 12, this positioning places the centerline of the left support structure 10 about 36 inches from the centerline of the right support structure 10, with the outside of the mounts 26 being no more than 48-52 inches wide (no more than 24-26 inches from the centerline of the boat 12).

The leg 24 continues pivoting to move its slide foot 28 further downward and outward, with the slide foot 28 fully extended, until the toe of the slide foot 28 makes contact with the ground. If desired, a spring, such as a torsion spring 36 shown in FIG. 4, may be used to ensure that the slide foot 28 remains fully extended until the toe contacts the ground. Alternatively, an air spring or compression spring may be used to slightly bias the slide foot 28 toward the fully extended position. If, for instance, the water depth between the bottom of the pontoons 20 and the ground is about 12 inches, then the slide foot 28 will move outward a beneath-pontoon-widening B of about another 2½ inches before the fully extended toe contacts the ground.

After the toe contacts the ground, further pivoting of the leg 24 drags the toe rearward across the ground and causes pivoting of the slide foot 28 (against the spring bias, if present) until the heel of the slide foot 28 contacts the ground, with the angle of the slide foot 28 matching the angle of the ground. Only after both the toe and the heel of the slide foot 28 contact the ground does the support structure 10 start raising the pontoon boat 12.

After both the toe and the heel of the tubular slide foot 28 contact the ground, further pivoting of the leg 24 starts pushing an arcuate surface 29 of the tubular slide foot 28 downward and outward into the ground and starts raising the pontoon boat 12. As the pontoon boat 12 is being raised in the water, the leg 24 and tubular slide foot 28 take on more and more of the weight of the boat 12, until the pontoons 20 are fully elevated to clear the surface of the water. For instance, if the boat 12 is loaded so (prior to lifting) the pontoons 20 are half above and half below the surface of the water, the tubular slide foot 28 will move outward a partially loaded slide C of about another 2½ inches after the heel contacts the ground before the tubular slide feet 28 and legs 24 take on the full weight of the pontoon boat 12.

It should be noted that this position, after the partially loaded slide C, is the position where the legs 24 will take on the greatest front-to-back bending moment. The size of the hydraulic cylinder 30 and the location that the hydraulic cylinder 30 is attached to the leg 24 is selected to adequately withstand these forces. In the preferred embodiment, the hydraulic cylinder 30 is attached about 25% of the way from the leg pivot pin 32 to the slide foot pivot pin 34, i.e., about 18 inches from the leg pivot pin 32.

After taking on the full weight of the pontoon boat 12, further pivoting of the leg 24 raises the bottom of the pontoons 20 further above the surface of the water, while pushing the slide feet 28 outward and widening the stance of the slide feet 28. Raising the boat 12 eighteen inches above the surface of the water will move each slide foot 28 a fully loaded slide D of another about 4 inches outward.

In this example then, each slide foot 28 has moved outward A+B+C+D=about 14 inches, that is, the stance of the slide feet 28 is about 28 inches wider than it would be without the cant θ. Moreover, the stance of the slide feet 28 is C+D=about 13 inches wider than when the slide feet 28 contacted the ground. With the preferred six foot leg length and preferred 13° cant, a fully raised pontoon boat 12 makes the slide feet stance 32 inches wider than it would be without the cant θ. That is, even though the right pontoon 20 is only separated about 52-56 inches from the left pontoon 20, the invention places the slide feet 28 at least 52-56 inches or more apart. The preferred embodiment places the centerlines of the slide feet 28 at a fully raised stance of about 68 inches apart.

Note that while use of the present invention has been described with respect to raising the boat 12 out of shallow water, the support structures can be equally used to raise and support the boat 12 when the boat 12 is being stored on land. Land use of the support structures is particularly appropriate such as for storing the boat 12 over winter, to minimize the likelihood of rodents or other non-flying animals from climbing on and damaging the boat 12.

Because the slide feet 28 are necessarily pushed across the surface of the ground to raise the boat 12, the slide feet 28 function and are designed much differently than the pads of the prior art. Instead of having flat surfaces intended to gain traction like a pad, the slide feet 28 have ramped, sloped or rounded surfaces. The preferred slide feet 28 are cylindrical tubes of six inch diameter. This wide diameter and gentle slope on the bottom of the slide tubes 28 enables them to slide with relatively little friction against hard surfaces, such as if the pontoon boat 12 is raised above a concrete boat ramp. The slide feet 28 will still slide across the concrete during raising of the boat 12. If desired, the slide feet 28 may have a bottom surface of a lubricious metal or plastic, or a replaceable wear and bearing surface, to facilitate sliding across hard surfaces. When used against a softer surface, such as mud, sand, or silt, the slide feet 28 will push an amount of mud/sand/silt outward as the slide feet 28 are pushed outward. That is, not only with the slide feet 28 take on a wider stance than possible with the Hodapp and Derner pads of the prior art, but the slide feet 28 will also modify the ground surface to give more solid footing to the slide feet 28 than when pads are merely placed down without moving.

It is not necessary for the slide feet 28 to be movable relative to the legs 24, only that (unlike the pads of the prior art) the slide feet 28 have an appropriately shaped surface for sliding even when fully loaded. Thus, an alternative embodiment forms a curved surface directly into the distal end of the legs 24.

The slide resistance or slide friction force during the fully loaded slide D will place a sideways bending moment on the leg 24 that did not exist in prior art structures. After the fully loaded slide D is completed, the wide-stance position will place a gravitational bending moment on the leg 24 in the opposite direction that did not exist in prior art structures. The attachment of the mount 26 and leg pivot pin 32 to the leg 24 must be robust to withstand these sideways bending moments.

The preferred embodiment, however, has the entire sideways bending moment on the leg 24 bourn by the mount 26 and hinge pin 32 connections, with the hydraulic cylinder 30 within the plane of travel of the leg 24. With the hydraulic cylinder 30 within the plane of travel of the leg 24, the hydraulic cylinder 30 can be attached to the mount 26 with a cylinder/mount pin 38 canted at the same angle θ as the leg pivot pin 32, and the hydraulic cylinder 30 can be attached to the leg 24 with a cylinder/leg pin 40 which is perpendicular to the longitudinal axis of the leg 24. If desired, an alternative embodiment has the cylinder positioned at an angle to the travel plane of the leg 24 to assist in supporting the leg 24 against the sideways bending moments. Because such an alternative arrangement takes the cylinder out of the travel plane of the leg 24, the cylinder preferably then has ball mount ends for the cylinder/mount attachment and for the cylinder/leg attachment.

Figure 1:
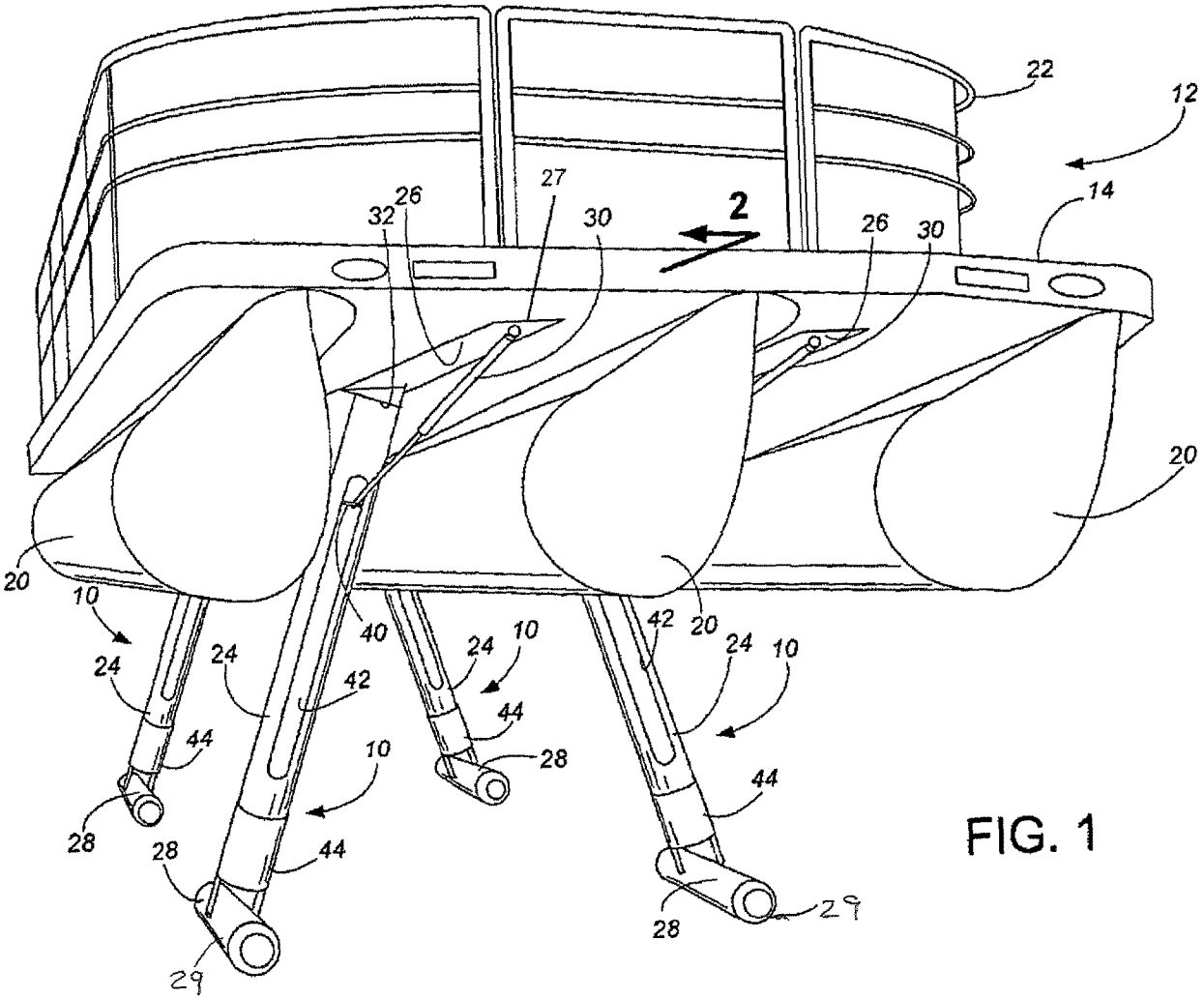
FIG. 1 is a perspective view of a first preferred embodiment of an onboard boat lift structure of the present invention, shown in the extended support position and out of water.

For the most balanced force on the leg 24 and to conceal and protect the cylinder 30 in the stowed position, the preferred embodiment has a front opening 42, with the cylinder 30 residing within the front opening 42 of the leg 24 in the stowed position, as best understood by comparing FIG. 1 and FIG. 4. To reduce the expense of cutting this front opening 42 in the leg 24, as another alternative the cylinder 30 can be attached immediately adjacent and parallel to the leg 24 in the stowed position, which is why the cylinder 30 can be shown in from of the leg 24 in the stowed position in FIG. 4.

With the narrow attachment point of the legs 24 to the platform 14 and narrow retracted position, the lift is designed for use with either twin or triple tube models. With the wide stance of the feet 28 when extended, there is little likelihood of tipping and the lift provides excellent stability even in windy conditions. The stability is further enhanced by the way the slide feet 28 push in sideways into soft mud/silt/sand.

The slide feet 28 are attached to the legs 24 at simple pivot pin hinges 34. When the legs 24 extend, the toes of the feet 28 extend downward (in line with the legs 24) due to gravity and the longer length of the feet 28 in front of the pivot pin hinge 34 than behind the pivot pin hinge 34. The rear ends of the feet 28 are received in arcuate leg top plates 44 which hold the feet 28 from extending vertically or straight toe-downward. When the toe of the foot 28 contacts the shore/lake bottom, further extension/pivoting of the leg 24 causes the foot 28 to pivot due to the drag of the shore/lake bottom on the extended toe, such that the heels of the slide foot 28 pulls downward out of its leg top plate 44. The gravitationally operated (possibly with spring assistance), wide stance feet 28 thus allow the slide feet 28 to provide a lift force against essentially any slope or undulation of shoreline.

The spring 36, if present, further ensures that the slide foot 28 extends in line with its leg 24 during extension or retraction, even if the boat 12 is moving and water drag would tend to otherwise turn the slide foot 28 relative to the leg 24. This is particularly important so the slide foot 28 is fully extended to enable positioning of the slide foot 28 and leg 24 immediately against the underside of the platform 14.

Each leg 24 is driven by a power linkage, which is controllable from above the platform 14. If desired, the power linkage could be manual, similar to the power linkage of the Raymond structure. More preferably, the power linkage is provided as a hydraulic lift cylinder 30 for each leg 24, without a mechanical attachment or coupling to any other leg 24 (other than through the deck of the boat 12). Without a mechanical attachment between legs 24, the legs 24 can be mounted on opposing sides of a middle tube 20 of a triple tube pontoon boat 12. The powering mechanism for the legs 24 preferably tends to keep the front legs 24 both in a uniform position and moving at a uniform speed, and preferably tends to keep the rear legs 24 both in a uniform position and moving at a uniform speed, but allows the front legs 24 to be extended/retracted separately from the rear legs 24 and vice versa.

Figure 5:
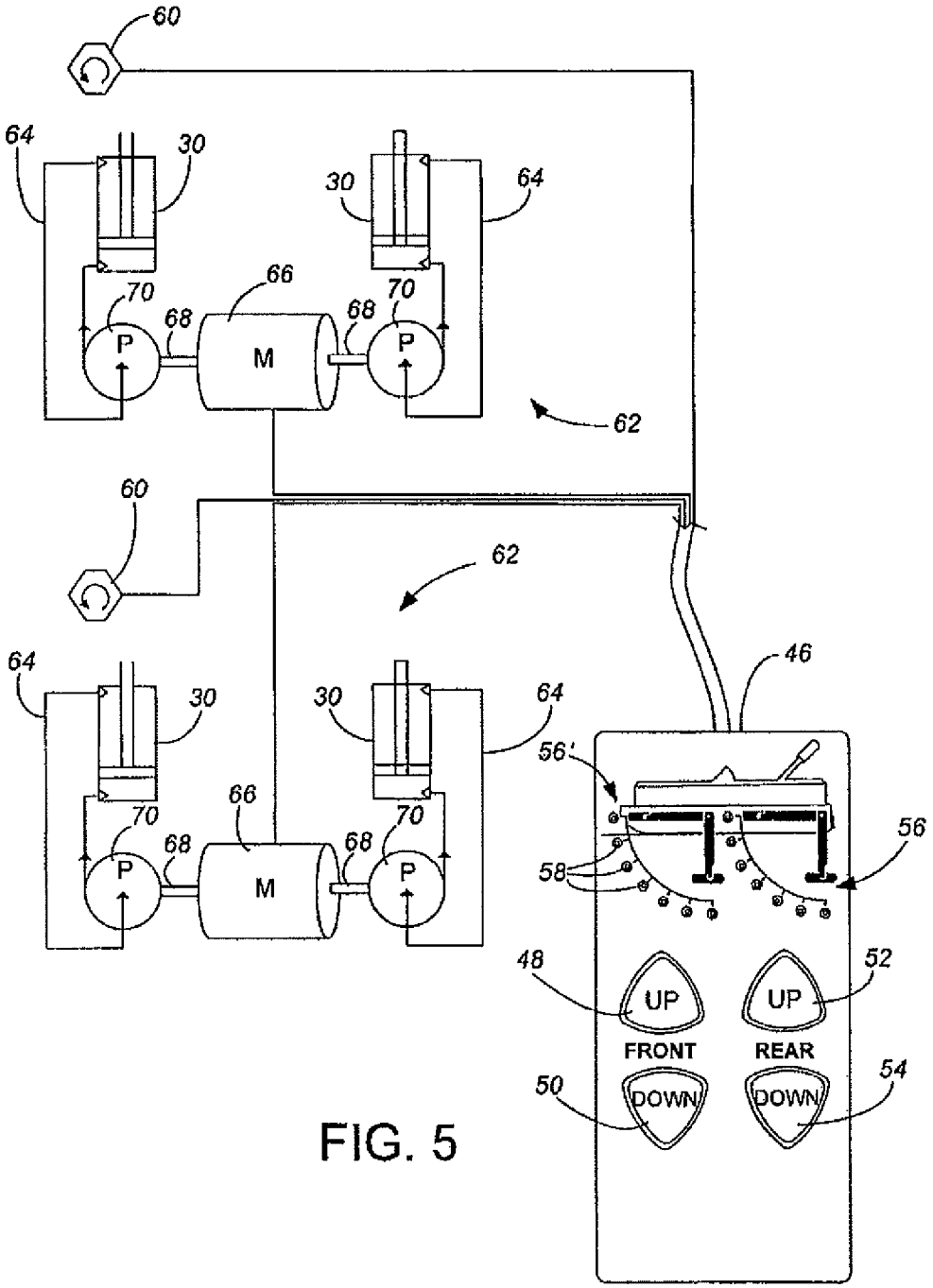
FIG. 5 is a plan view, in partial schematic, showing the control and power arrangement for the preferred embodiment.

The preferred control 46 for the present invention is shown in FIG. 5. The control 46 includes an up button 48 for the front legs 24, a down button 50 for the front legs 24, an up button 52 for the rear legs 24 and a down button 54 for the rear legs 24. These buttons 48, 50, 52, 54 enable the user to raise/lower the front of the pontoon boat 12 to a different height or separately than the rear of the pontoon boat 12, which is particularly important when raising the boat 12 on a sloped ground surface. That is, the separate front buttons 48, 50 and rear buttons 52, 54 enable the boat 12 to be leveled regardless of the grade of the shoreline/lake bottom contour, provided the boat 12 is positioned in-line with the direction of the grade so there is no side-to-side grade. Because the shoreline is typically perpendicular to the direction of the grade, it is easy for the boat operator to ascertain which direction to park the boat 12 parallel to the grade so the boat 12 can be lifted and fully leveled without any right-to-left leveling mechanism on the lift, keeping the control 46 relatively simple. Many equivalent controls can be used, including using a single rocker button for both up and down, via wired or wireless remote control, etc.

The control 46 also includes displays 56 and 56' which show the relative position of each set of legs 24. The preferred display 56 and 56' is low cost, such as a series of two or more LEDs 58 which can be lit to show how far the set of legs 24 is extended or retracted. For instance, the preferred control 46 has seven LEDs 58 which light to mark the extension of each set of legs 24 in approximately 15° increments. The LEDs 58 are positioned appropriately on the control 46 to communicate the meaning of each display 56 and 56', such as in two quarter circles relative to a printed or painted on depiction of a pontoon boat on the control 46. The LEDs 58 are inherently low power. Additional power savings can be accomplished by lighting the LEDs 58 only when one of the buttons 48, 50, 52, 54 is being pressed or has recently been pressed. Other display configurations which could be used include dial or needle type displays, or other similar displays used on vehicle control panels and dashboards.

If desired, the control 46 may be set to time the duration of pressing the up and down buttons 48, 50, 52, 54, with the displays 56 estimating position based upon such timing. More preferably, a sensor 60 is positioned under the platform 14 which directly senses the position of one or both legs 24. For instance, the sensor 60 may be a simple position sensor which directly assesses the angle of a leg 24 relative to its mount 26. Alternatively, the sensor could assess the amount of extension of its cylinder 30. Additional displays may be added to the control 46, such as one for each support structure 10, particularly useful if the support structures are independently movable.

In the preferred embodiment, two hydraulic pump arrangements 62 are provided, one pump arrangement 62 for powering the front support structures 10 and the other pump arrangement 62 for independently powering the rear support structures 10. The pump arrangements 62 are preferably mounted above deck, with hydraulic power lines 64 running from the above-deck pump arrangements 62 to the below deck hydraulic cylinders 30.

Each power arrangement centrally includes a double-shafted, bi-directional motor 66. Each of the two shafts 68 drives a hydraulic bi-rotational pump 70, with each pump 70 being provided with its own oil reservoir (not separately shown). Switching for the bi-directional motor 66 is preferably provided by a reversing polarity DC Contactor (not shown), and electronic circuit protection equipment (not shown) preferably is used to protect the reversing polarity DC Contactor and the motor 66. This simple equipment, using a single motor 66 for each set of support structures 10, will cause separate right and left support structures 10 to extend or retract in unison at a consistent speed, despite not having a mechanical linkage to equalize speed or forces between the right and left support structures 10, and despite having two separate hydraulic circuits 64. The two separate hydraulic circuits 64 are particularly beneficial for maintenance and troubleshooting of the hydraulic circuits 64, since properly tuned and working hydraulic circuits 64 will result in properly timed and positioned extension and retraction of the right and left support structures 10. If a component of the hydraulic circuit 64 undergoes a problem, such as a leak or a high wear rate, that problem will evidence itself by improper timing or positioning of one of the support structures 10, so the problem can be detected and corrected before causing further damage or catastrophic failure.

Although the present invention has been described with reference to preferred embodiments, workers skilled in the art will recognize that changes may be made in form and detail without departing from the spirit and scope of the invention.

What is claimed is:

1. A method of raising a boat using an onboard boat lift wherein the boat includes outer buoyant pontoons at port and starboard sides of the boat that support a deck, the method comprising:

providing a plurality mounting plates secured to an underside of the deck, each mounting plate having a substantially flat attachment surface;

providing a plurality of first mounting brackets, each first mounting bracket comprising a pivot pin and each first mounting bracket secured to the attachment surface of one of the plurality of mounting plates;

providing a plurality of second mounting brackets, each second mounting bracket comprising a mounting pin, each second mounting bracket secured to the attachment surface of one of the plurality of mounting plates and each second mounting bracket spaced apart from first mounting bracket on the attachment surface of one of the plurality of mounting plates;

providing a plurality of support legs, wherein each of the plurality of support legs is attached with the pivot pin to each first mounting bracket;

providing a plurality of hydraulic cylinders, wherein each of the plurality of hydraulic cylinders is attached with the mounting pin to each second mounting bracket, and wherein each mounting pin is positioned relative to the attachment surface at substantially the same angle as each pivot pin such that each pivot pin and each mounting pin on each attachment surface are mounted such that neither pin is parallel to a plane of a surface of the attachment surface;

pivoting each support leg about a canted pivot axis relative to the attachment surface of the mounting plate from a substantially horizontal, retracted position to an extend position in an arcuate path;

mechanically coupling a tubular slide foot to each support leg using a pivot pin extending through the tubular slide foot in at least two locations, wherein each tubular slide foot engages a bed below a body of water;

continuing the pivoting of each support leg, resulting in an arcuate surface of the tubular slide foot sliding across a ground surface while the boat is raised until each support leg is substantially perpendicular to the deck; and retracting each support leg from the substantially upright support position to the substantially horizontal retracted position such that when each support leg is retracted in the substantially horizontal retracted position such that each tubular slide foot attached to each support leg is located between the outer buoyant pontoons.

2. The method of claim 1, further comprising extending each tubular slide foot downwardly until a toe of each tubular slide foot contacts the ground.

3. The method of claim 2, further comprising biasing each tubular slide foot toward an extended position.

4. The method of claim 1, wherein the plurality of support legs further includes first and second right support legs and first and second left support legs.

5. The method of claim 1, wherein each support leg is moved with a hydraulic cylinder.

6. The method of claim 5, wherein each support leg includes an opening, and wherein the method further comprises receiving the hydraulic cylinder at the opening when each support leg is in the substantially horizontal retracted position.

7. The method of claim 6, further comprising positioning the hydraulic cylinder beside each support leg when each support leg is in the substantially horizontal retracted position.

8. A method of raising a boat using an onboard boat lift wherein the boat includes port and starboard sides of the boat, the method comprising:

attaching a mounting plate having a substantially flat attachment surface of a plurality of mounting plates having substantially flat attachment surfaces to an underside of a deck of the boat;

attaching a mounting bracket of a plurality of mounting brackets comprising a pivot pin to the attachment surface of each mounting plate and mounting a support leg of a plurality of support legs with the pivot pin, wherein the pivot pin is mounted to the attachment surface at an angle with respect to the attachment surface to provide an angled pivot axis for each support leg attached thereto;

extending each support leg of the plurality of support legs from a substantially horizontal retracted position to a substantially upright support position, the plurality of support legs including at least a right support leg and a left support leg;

pivoting the support leg about the respective pivot axis that is canted relative to an end of the support leg, wherein the end of the support leg is attached to an underside of the boat, and wherein an opposing end of the support leg includes a tubular slide foot pivotally attached to the support leg with a pivot pin extending through the tubular slide foot in at least two locations;

with the pivoting of the support leg, engaging an arcuate portion of the tubular slide foot with the ground surface to move the tubular slide foot across a ground surface to raise the boat;

retracting the support leg from the substantially upright support position to the substantially horizontal retracted position such that when the support leg is retracted in the retracted position the tubular slide foot is located underneath a central portion between the port and starboard sides of the boat; and indicating positions of the plurality of support legs via a control communicatively coupled to the onboard boat lift.

9. The method of claim 8, further comprising:

a first display of the control indicating position of front support legs of the plurality of supports legs; and a second display of the control indicating position of back support legs of the plurality of supports legs.

10. The method of claim 9, further comprising indicating the positions of the front and back support legs using light-emitting diodes.

11. The method of claim 8, further comprising controlling the extending, retracting, or pivoting of the support leg according to user input received via the control.

12. The method of claim 8, wherein the pivot axis is canted from 5 to 30° relative to a horizontal plane of the boat.

13. A method of raising a boat using an onboard boat lift wherein the boat includes outer buoyant pontoons at port and starboard sides of the boat, the method comprising:

attaching a plurality of support structures including front and rear right support structures and front and rear left support structure to an underside of the boat and between the outer buoyant pontoons, wherein each support structure comprises a leg extending to a tubular slide foot with an arcuate portion wherein the tubular slide foot is mechanically coupled to each support leg using a pivot pin extending through the tubular slide foot in at least two locations;

lowering the tubular slide foot of the right support structure and the tubular slide foot of the left support structure until the tubular slide feet make contact with the ground surface;

after each tubular slide foot contacts the ground, widening the stance of each tubular slide foot by pushing each tubular slide foot outward through the engagement of the arcuate portion of the tubular slide foot with the ground surface to raise the boat, such that when the support structures are extended in upright support positions each tubular slide foot is located below and outside horizontally with respect to the port and starboard sides of the boat or at least underneath the outer buoyant pontoons; and adjusting a height of the rear left and right support structures relative to the front left and right support structures to substantially level the boat.

14. The method of claim 13, wherein the lowering and widening of each tubular slide foot occur by pivoting the legs about canted pivot axes that are canted relative to a horizontal plane of the boat.

15. The method of claim 14, further comprising indicating positions of the plurality of support structures via a control communicatively coupled to the onboard boat lift.

16. The method of claim 13, wherein the canted pivot axis is canted from 5 to 30° relative to the horizontal plane of the boat.

* * * * *